US007631611B1

(12) United States Patent
Dick et al.

(10) Patent No.: US 7,631,611 B1
(45) Date of Patent: Dec. 15, 2009

(54) UNDERWATER VEHICLE

(75) Inventors: James L. Dick, Saunderstown, RI (US); Duane M. Horton, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 70 days.

(21) Appl. No.: 11/842,187

(22) Filed: Aug. 21, 2007

(51) Int. Cl.
*B63G 8/00* (2006.01)
*B63G 8/14* (2006.01)

(52) U.S. Cl. ..... 114/312; 114/332

(58) Field of Classification Search ..... 114/312, 114/316–325, 337, 338, 238, 239, 258–260, 114/330, 332; 89/1.809, 1.81, 5; 102/390, 102/399, 406; 405/188–194
See application file for complete search history.

(56) References Cited

U.S. PATENT DOCUMENTS 3,550,388 A * 12/1970 Smith et al. ..... 405/188
3,857,351 A * 12/1974 Wynn et al. ..... 114/322
3,897,743 A * 8/1975 Schoonman ..... 114/321
4,145,290 A * 3/1979 Nagy et al. ..... 210/242.3
5,661,259 A * 8/1997 Cipolla ..... 114/23

FOREIGN PATENT DOCUMENTS

DE 102005051374 A1 * 5/2007
EP 1798145 A2 * 6/2007

* cited by examiner

*Primary Examiner*—Ajay Vasudeva
(74) *Attorney, Agent, or Firm*—James M. Kasischke; Jean-Paul A. Nasser; Michael P. Stanley

(57) ABSTRACT

An underwater vehicle is provided with facility for affixing to and maintaining station on a hull of another marine vehicle. The underwater vehicle includes a hull with a propulsion means for movement underwater. Maneuvering planes are mounted on the hull. Body panels are movably fixed to the hull and are moveable from first positions in which the panels conform to a shape of the hull to second positions in which the panels extend outwardly from the hull and toward the other marine vehicle, free edges of the panels being engageable with the other marine vehicle to deter flow of water between the underwater vehicle hull and the other marine vehicle and guide flow of water around the underwater vehicle hull to pin the underwater vehicle against the other marine vehicle hull.

12 Claims, 9 Drawing Sheets

UNDERWATER VEHICLE

STATEMENT OF GOVERNMENT INTEREST

The invention described herein may be manufactured and used by or for the Government of the United States of America for Governmental purposes without the payment of any royalties thereon or therefor.

CROSS REFERENCE TO OTHER PATENT APPLICATIONS

None.

BACKGROUND OF THE INVENTION (1) Field of the Invention

The present invention relates to underwater vehicles which can be unmanned and untethered and more particularly to an underwater vehicle having facility for affixing to and maintaining station on an underwater hull portion of another marine vehicle.

(2) Description of the Prior Art

Underwater vehicles are known and are used for a variety of missions, including anti-mine operations, oceanographic analysis, reconnaissance, intelligence gathering, and tracking of marine vehicles. These vehicles can be either manned or more commonly unmanned. Retrieval of underwater vehicles which have completed their missions has heretofore involved a submarine or other naval vessel maneuvering alongside the underwater vehicle and mechanically grabbing the underwater vehicle. Maneuvering a submarine is much more difficult than maneuvering an underwater vehicle. In addition, the underwater vehicle is sometimes in high sea states or near dangerous coastal obstacles. Maintaining stealth is more difficult with a large submarine than with an underwater vehicle. Accordingly, there is a need for an underwater vehicle which can maneuver to engage a retrieving vehicle, whether submarine or surface vessel, and cling to the hull of the retrieving vehicle until the retrieving vehicle reaches a safe location for removal of the underwater vehicle.

SUMMARY OF THE INVENTION

An object of the invention is, therefore, to provide an underwater vehicle having facility for maneuvering alongside a retrieving vehicle, engaging the hull of the retrieving vehicle, and clinging to the hull of the retrieving vehicle until removal therefrom.

With the above and other objects in view, a feature of the present invention is the provision of an underwater vehicle having facility for affixing to and maintaining station on a hull of another marine vehicle. The underwater vehicle comprises a self-powered hull for movement underwater, and maneuvering planes mounted on the hull for effecting changes in course when the underwater vehicle is underway. Body panels are movably fixed to the hull and moveable from first positions in which the panels conform to the hull shape to second positions in which the panels extend outwardly from the hull and toward an engagement region of the other marine vehicle. Free edges of the panels are engageable with the hull of the other marine vehicle to deter flow of water between the underwater vehicle hull and the hull of the other marine vehicle and guide flow of water around the underwater vehicle hull to pin the underwater vehicle against the other marine vehicle hull.

In accordance with a further feature of the invention, there is provided an underwater vehicle having facility for affixing to and maintaining station on a hull of another marine vehicle. The underwater vehicle comprises a self-powered hull for movement underwater and maneuvering planes mounted on the hull for effecting changes in course when the underwater vehicle is underway. Arms are pivotally mounted on the underwater vehicle hull such that in a non-extended condition the arms are disposed within an outboard surface of the underwater vehicle hull. The arms are extendible from the underwater vehicle hull upon the underwater vehicle hull engaging the hull of the other marine vehicle. The arms engage the hull of the other marine vehicle and generally conform to an outside configuration of the hull of the other marine vehicle. Attachment devices are fixed to the arms to engage the hull of the other marine vehicle and hold the underwater vehicle on the hull of the other marine vehicle.

In accordance with a still further feature of the invention, there is provided an underwater vehicle having facility for affixing to and maintaining station on a hull of another marine vehicle. The underwater vehicle comprises a self-powered hull for movement underwater and maneuvering planes mounted on the hull for effecting changes in course when the underwater vehicle is underway. An engagement side of the underwater vehicle hull is of a concave configuration, an engagement portion of the hull of the other marine vehicle is of a convex configuration, and the remainder of the underwater vehicle hull is of a convex configuration. Water flowing over the remainder of the underwater vehicle hull pins the engagement side of the underwater vehicle hull against the engagement portion of the hull of the other marine vehicle.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent, wherein corresponding reference characters indicate corresponding parts throughout the several views of the drawings and wherein.

DESCRIPTION OF THE PREFERRED EMBODIMENT

Figure 1:
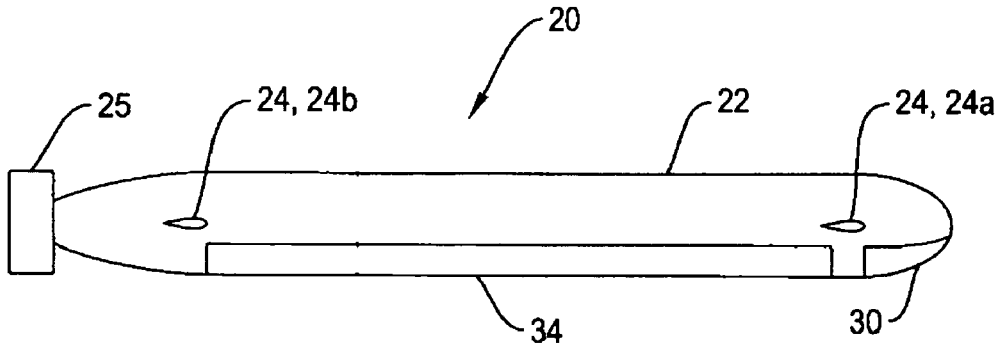
FIG. 1 is a side elevational view of one form of a Underwater Vehicle illustrative of an embodiment of the invention.

Referring to FIG. 1, it will be seen that an illustrative underwater vehicle 20 comprises an elongated hull 22 having maneuvering planes 24 mounted thereon, typically on opposite sides of the hull (one side seen in FIG. 1) and moveable to effect course changes of the vehicle 20. The maneuvering planes 24 typically include bow planes 24*a* and stern planes 24*b*. The underwater vehicle is self-propelled and contains a guidance system responsive to preprogramming and electronic instructions received from a controlling station.

After completion of a mission by the underwater vehicle, the underwater vehicle may be guided into position alongside a retrieving vessel 26. See FIG. 2. The bow and stern planes 24*a* and 24*b* are moved by the control system (not shown) to bring the hull 22 of the underwater vehicle 20 into engagement with an underwater hull portion 28 of the retrieving vessel 26.

Figure 2:
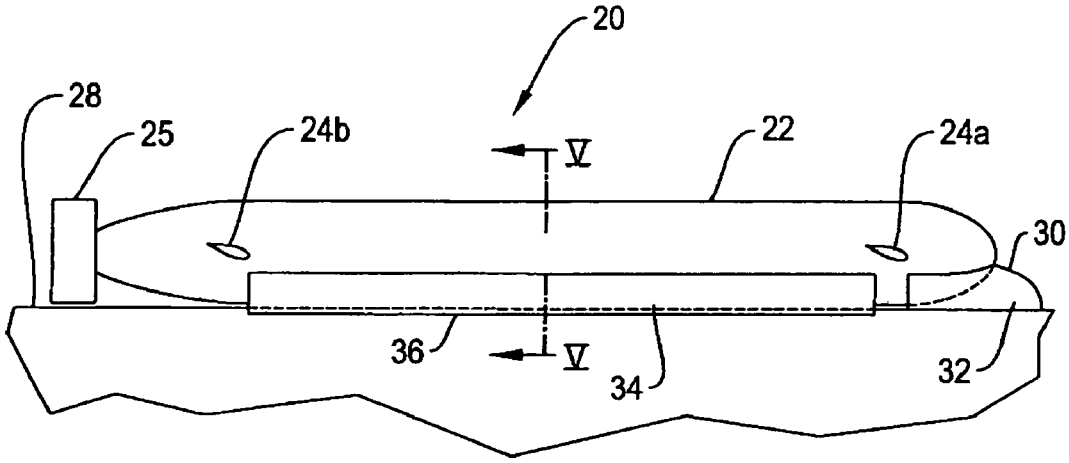
FIG. 2 is similar to FIG. 1 but showing maneuvering planes deployed for urging the underwater vehicle toward a hull of another marine vehicle, the underwater vehicle engaged with the other marine vehicle hull, and panels deployed from the underwater vehicle and engaged with the other marine vehicle hull.
Figure 3:
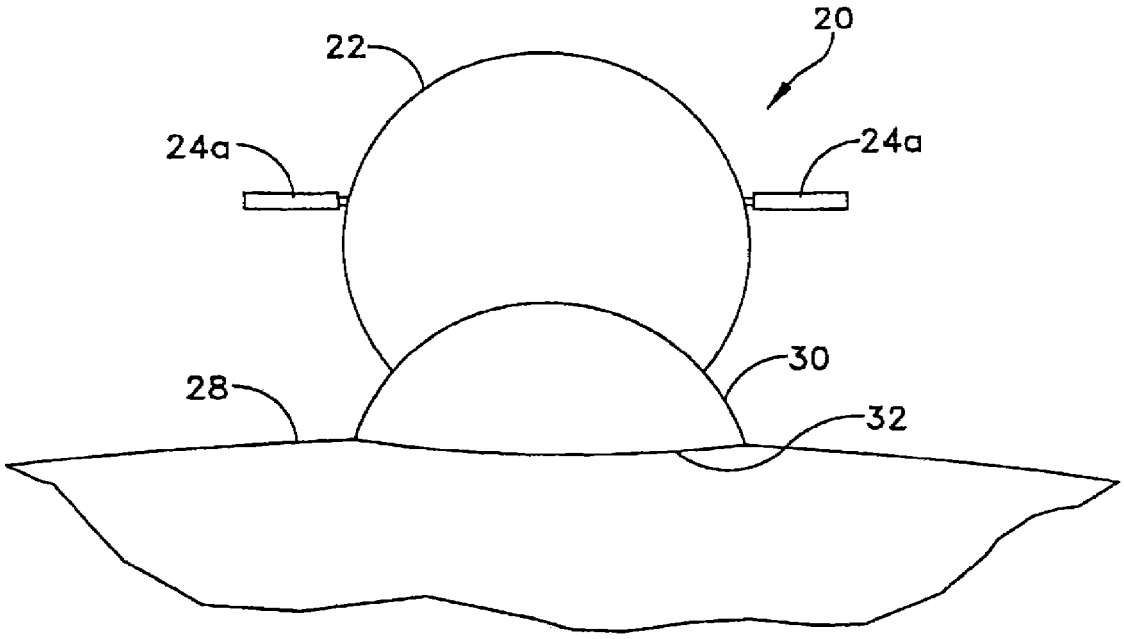
FIG. 3 is a front, or bow view of the underwater vehicle with the forward panel deployed.
Figure 4:
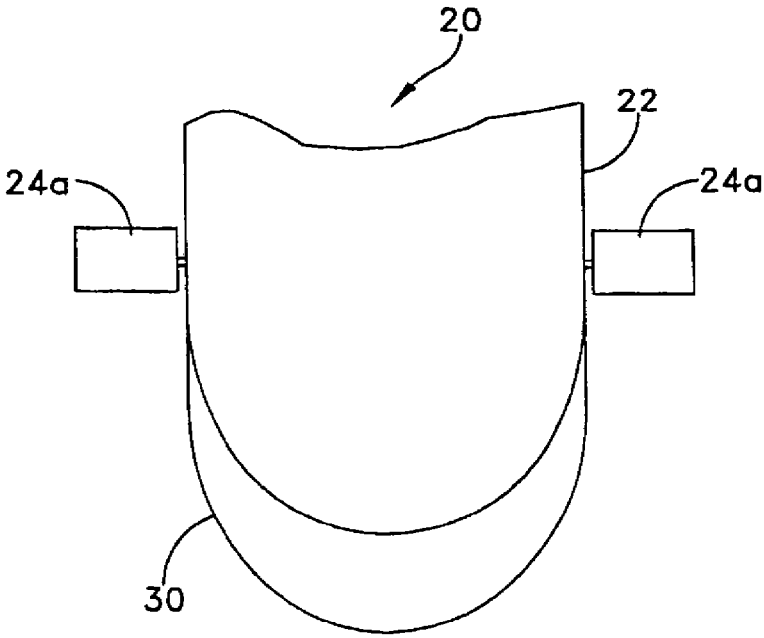
FIG. 4 is a top view of the underwater vehicle opposite the engagement side, with the forward panel deployed.
Figure 5:
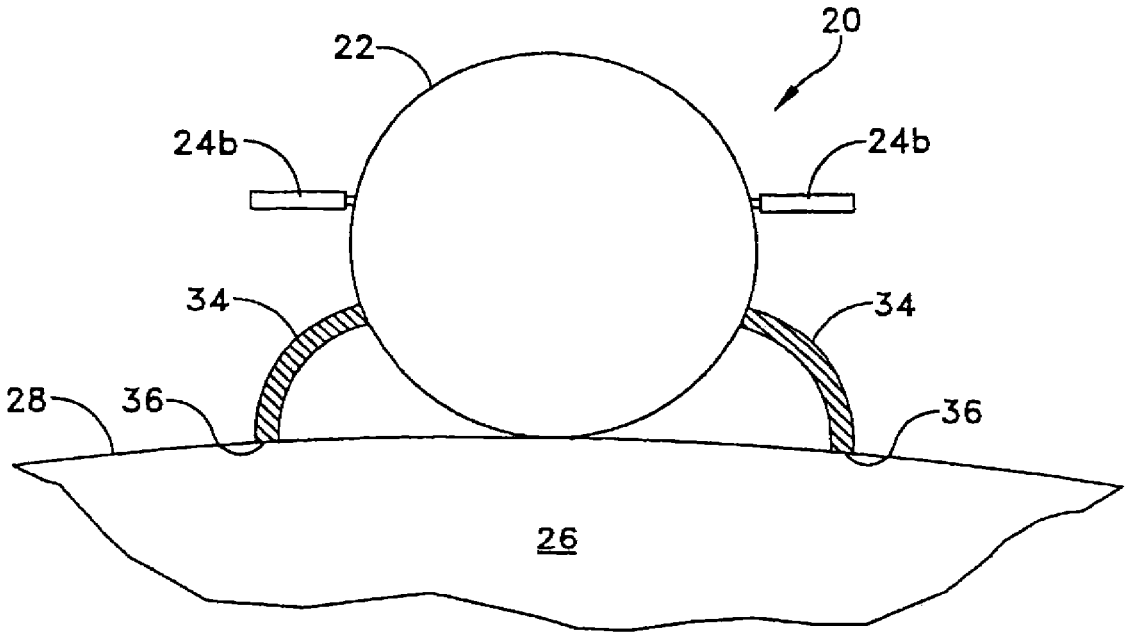
FIG. 5 is a sectional view of the underwater vehicle taken along line V-V of FIG. 2, with side panels deployed and engaged with the other marine vehicle hull.
Figure 6:
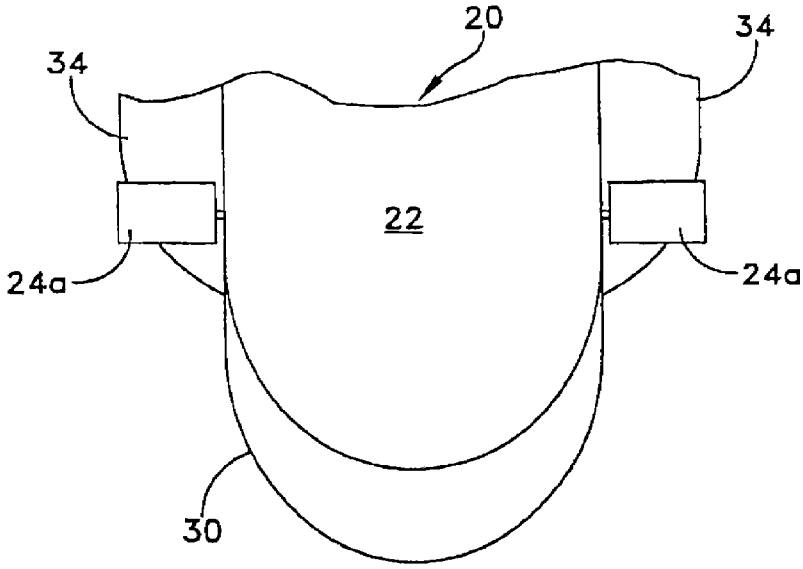
FIG. 6 is a top view showing the forward and side panels deployed.
Figure 7:
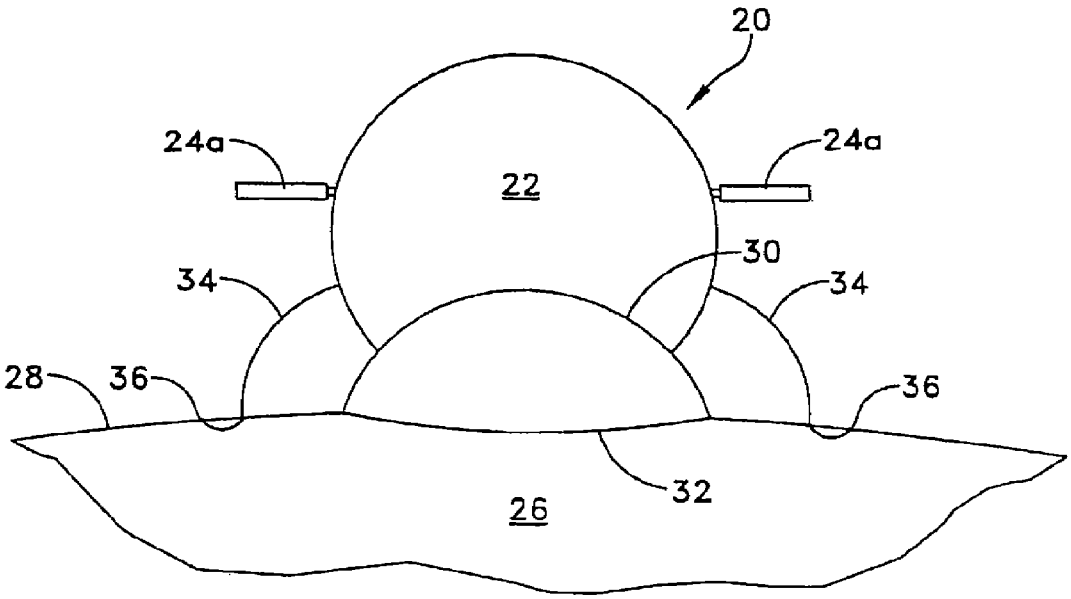
FIG. 7 is a front or bow view showing the forward and side panels deployed.

Upon engagement of the underwater vehicle 20 with the retrieving vessel 26, the underwater vehicle deploys a forward panel 30 (FIGS. 2, 3 and 41, a free edge 32 of which engages the hull 28. The panel 30 is curved (FIG. 2) in such a manner as to direct the flow of water along the side of the hull 28 around the underwater vehicle hull 22 rather than between the underwater vehicle hull 22 and the retrieving vessel hull 28. Such flow tends to pin the underwater vehicle 20 against the hull 28 of the vessel 26.

To further assist in pinning the underwater vehicle 20 to the vessel 26, the underwater vehicle is provided with side panels 34 (FIGS. 2, 5-7) which extend from the underwater vehicle and have free edges 36 which engage the hull 28. The side panels 34 further direct water flow around the underwater vehicle 20 and substantially block flow between the underwater vehicle and the retrieving vessel. The panels 30, 34 conform to the shape of the underwater vehicle hull 22 when not extended, as shown in FIG. 1. The free edges 32, 36 of the panels generally conform to the shape of the retrieving vessel hull 28 when the panels are extended. Panels 30, 34 can be extended by electrical, mechanical, pneumatic or hydraulic actuators means known in the art.

Figure 8:
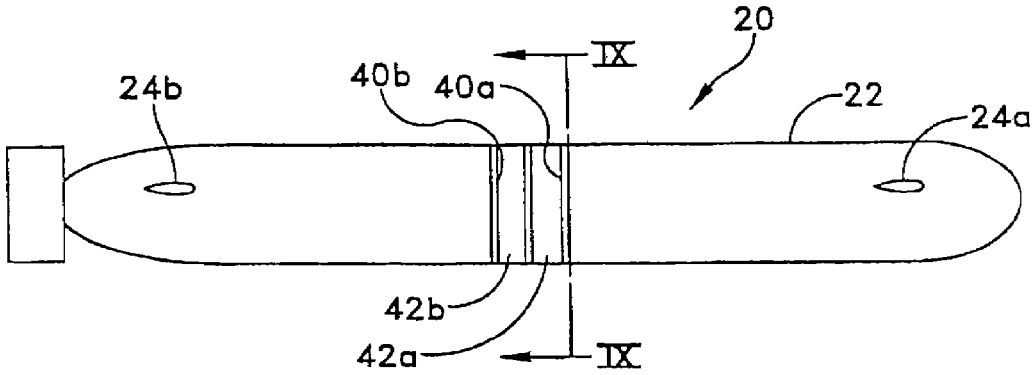
FIG. 8 is a side elevational view of an underwater vehicle and illustrative of another embodiment of the invention.
Figure 9:
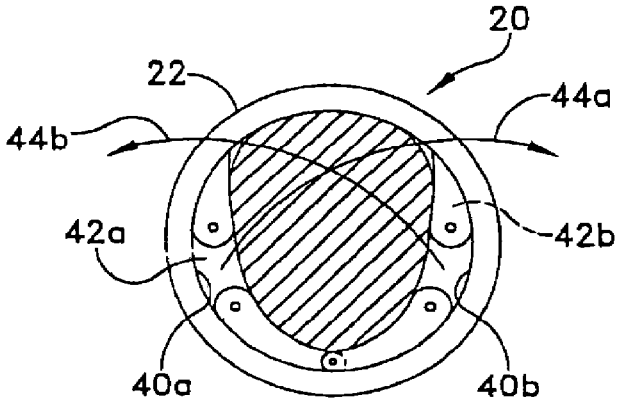
FIG. 9 is a sectional view taken along line IX-IX of FIG. 8, showing an alternative grasping feature for engaging the hull of the other marine vehicle.
Figure 10:
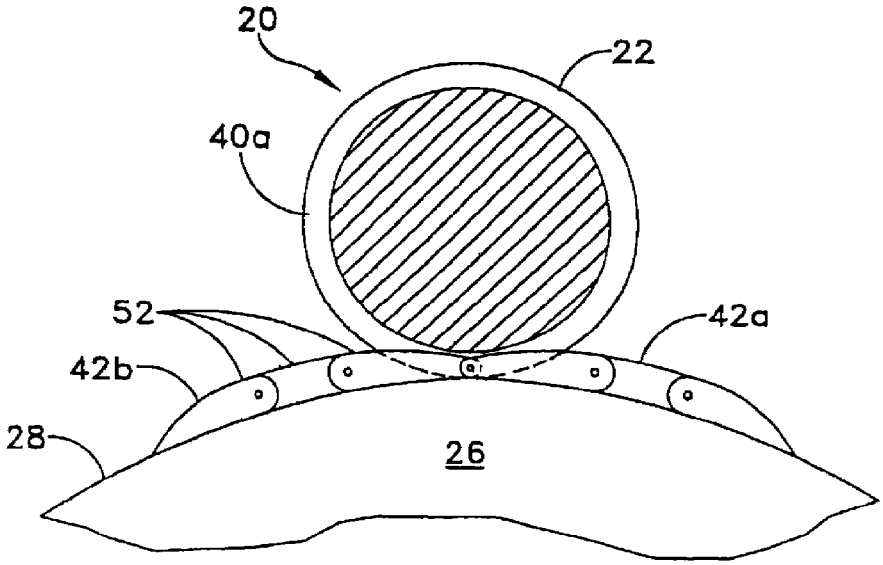
FIG. 10 is similar to FIG. 9 but showing the grasping feature deployed to engage the hull of the other marine vehicle.

Referring to FIGS. 8-10, it will be seen that in an alternative embodiment the underwater vehicle 20 is provided with a pair of annular recesses 40*a*, 40*b*, in which are disposed, respectively, linkage arms 42*a* and 42*b*. The linkage arms 42*a*, 42*b* are spring biased, such that upon release from their recesses 40*a*, 40*b*, which occurs upon engagement of the underwater vehicle hull 22 with the retrieving vessel hull 28, the arms spring outwardly in the direction of arrows 44*a*, 44*b* in FIG. 9 to engage the hull 28, as shown in FIG. 10. The linkages 52 of the arms 42*a*, 42*b* permit the arms to conform to the configuration of the hull 28.

Figure 11:
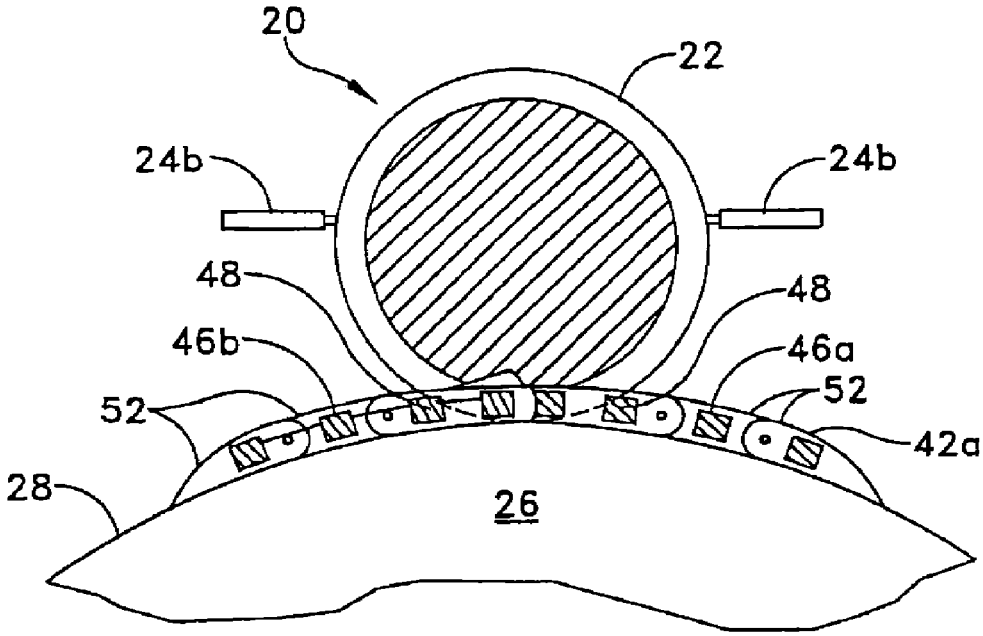
FIGS. 11 and 12 are similar to FIG. 10, but illustrative of an additional grasping feature.
Figure 12:
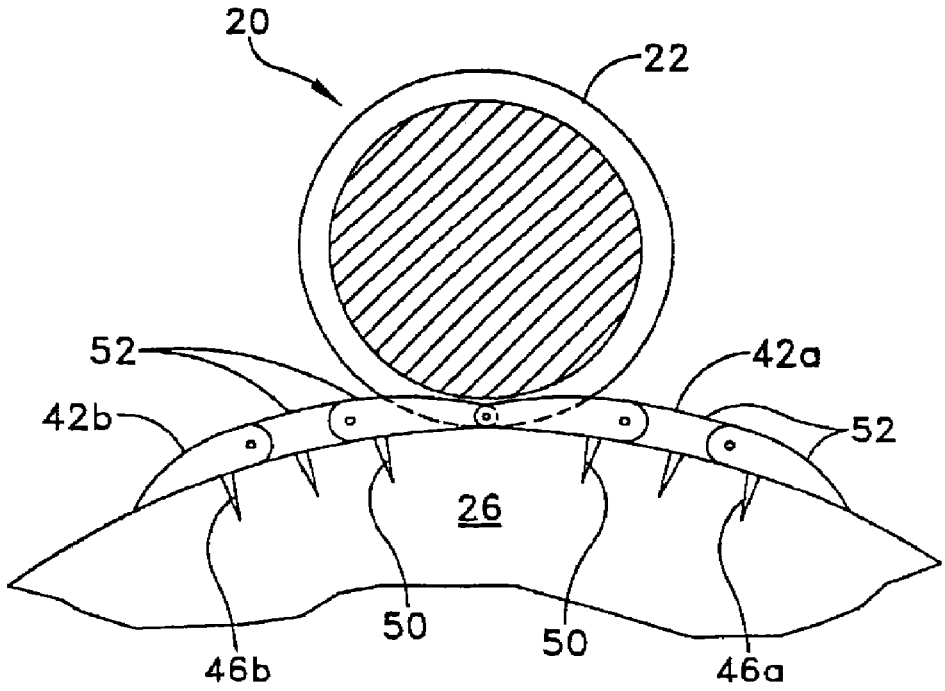

To enable the underwater vehicle 20 to remain fastened to the retrieving vehicle hull 28, the linkage arms 42*a*, 42*b* are provided with attachment devices 46*a*, 46*b*, which may comprise magnetic devices 48 (FIG. 11), spikes 50 (FIG. 12), or the like. The magnetic devices 48 anchor securely to steel structures, such as submarine hulls. Magnetic devices 48 can be electromagnets. The spikes 50 are useful with respect to soft submarine coverings. An attachment region having improved attachment characteristics can be provided on the retrieving vehicle.

Figure 13:
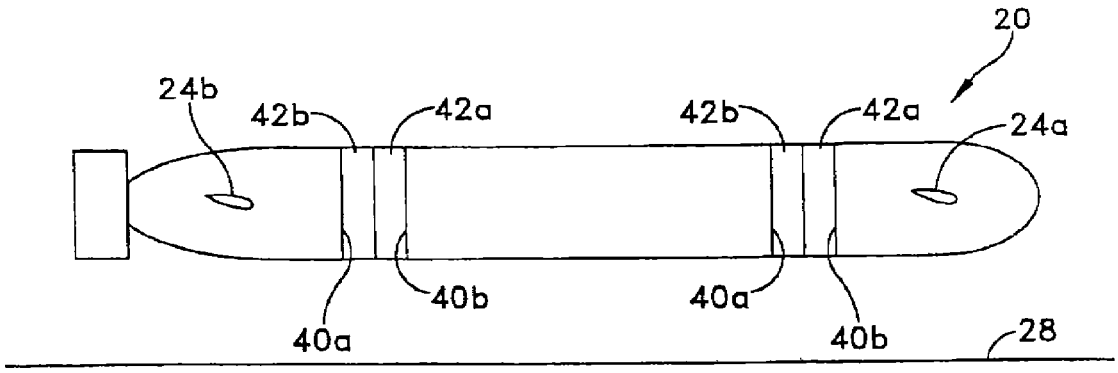
FIG. 13 is similar to FIG. 8, but showing a plurality of grasping units.
Figure 14:
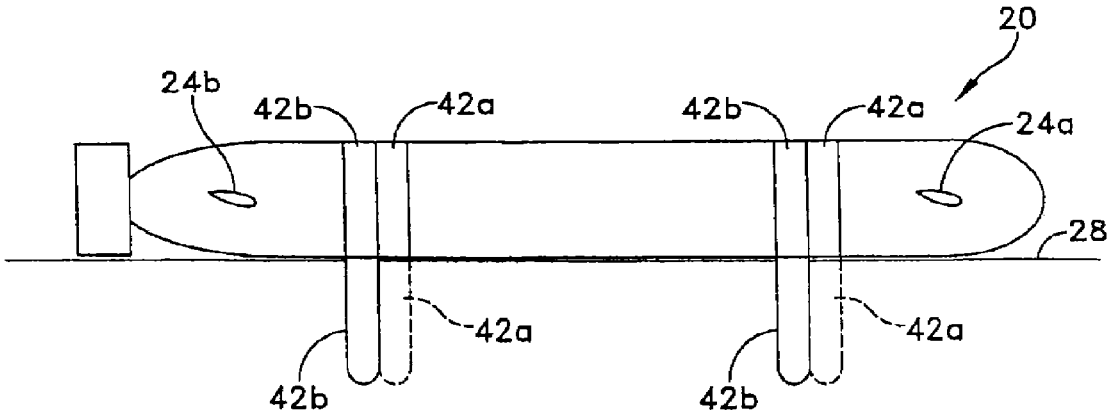
FIG. 14 is similar to FIG. 13, but shows the grasping units deployed for engagement with the hull of the other marine vehicle.

As shown in FIGS. 13 and 14, a plurality of pairs of arms 42*a*, 42*b*, may be used to insure that a proper grasping feature is engageable with a hull 28 whose structure is unknown.

Figure 15:
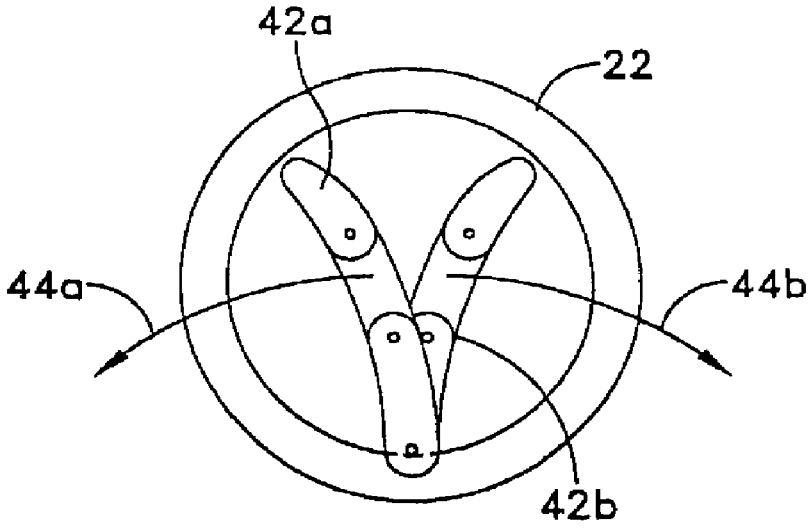
FIGS. 15 and 16 illustrate a further alternative embodiment of grasping units.
Figure 16:
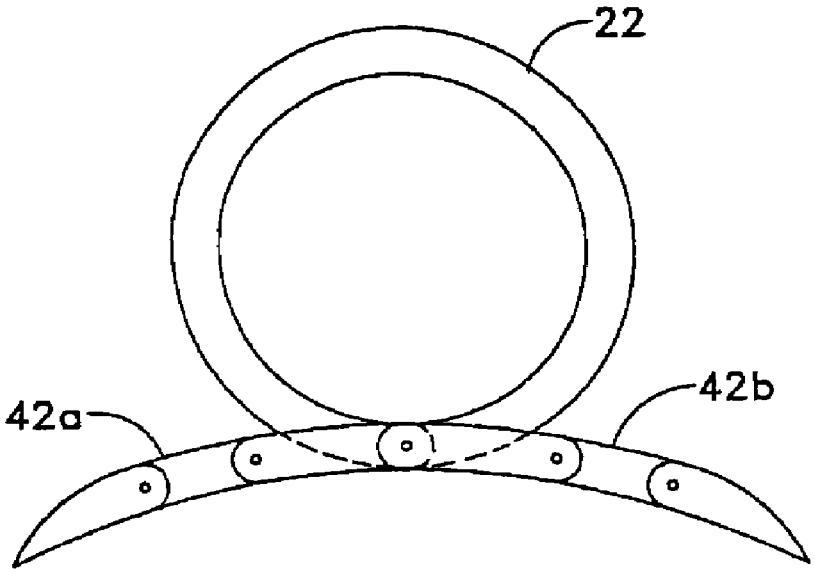

In FIGS. 15 and 16 an alternative arrangement of arms 42*a* and 42*b* is shown in which the arms move oppositely from directions shown in FIGS. 9 and 10, but accomplish the same tasks in much the same manner.

It will be apparent that the features of FIGS. 1-7 may be combined with the features of FIGS. 8-14, it being necessary to provide a plurality of side panels 34 on each side panel side of the underwater vehicle hull 22, rather than the one long panel 34 shown in FIG. 2, to accommodate the recesses 40*a*, 40*b* for the linkage arms 42*a*, 42*b*.

Figure 17:
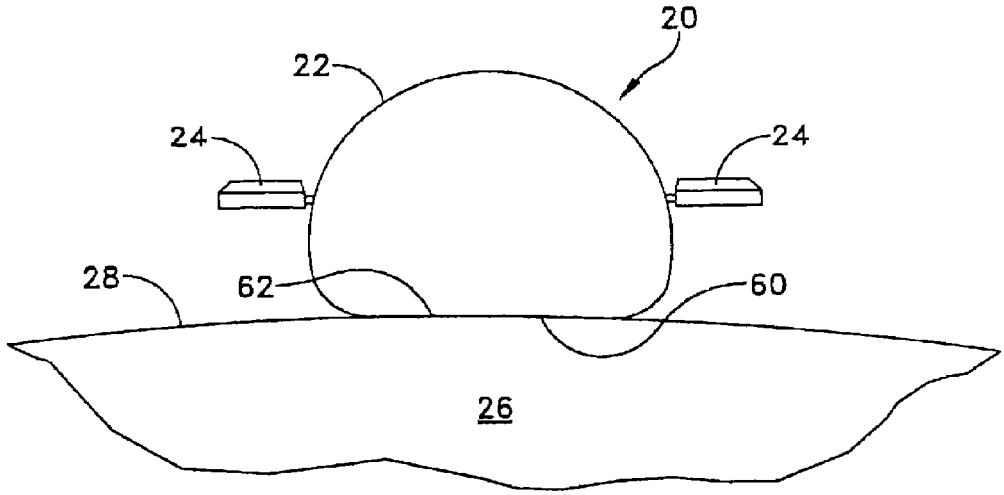
FIG. 17 is a front or bow view of an underwater vehicle having alternative means for engagement with the hull of the other marine vehicle.
Figure 18:
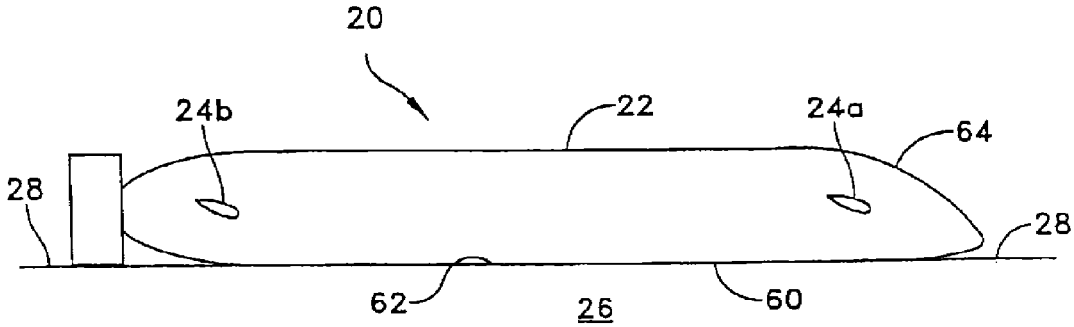
FIG. 18 is a side elevational view of the underwater vehicle of FIG. 17.

Referring to FIGS. 17 and 18, it will be seen that in a still further embodiment of the invention, an engagement side 60 of the underwater vehicle hull 22 is of a concave configuration and an engagement portion 62 of the hull 28 of the retrieving vehicle 26 is of a convex configuration. The remainder of the underwater vehicle hull is of a convex configuration. Further, the nose or bow portion 64 (FIG. 18) of the underwater vehicle is angled asymmetrically so as to direct a water stream over the remainder of the underwater vehicle hull 22. Thus, water flowing over the remainder of the hull pins the engagement side 60 of the underwater vehicle 20 against the engagement portion 62 of the hull 28 of the retrieving vehicle 26.

There is thus provided an underwater vehicle having facility for maneuvering alongside a retrieving vehicle, as by manipulation of bow and stern planes, for engaging a hull surface of the retrieving vehicle, and for pinning the underwater vehicle to the retrieving vehicle hull.

Subsequently, the underwater vehicle can be removed from the hull of the retrieving vehicle. Alternatively, the underwater vehicle may be used as a guided mine which attaches to the hull of an enemy ship and detonates to open a large hole in the hull of the host ship. It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. An underwater vehicle having facility for maintaining station on an other marine vehicle hull, the underwater vehicle comprising:

a self-propelled underwater vehicle hull configured movement underwater;

maneuvering planes mounted on said underwater vehicle hull; and body panels movably fixed to said underwater vehicle hull and moveable from first positions in which said panels conform to a shape of said underwater vehicle hull, to second positions in which said panels extend outwardly from said underwater vehicle hull, free edges of said panels being engageable with the other marine vehicle hull to deter flow of water between said underwater vehicle hull and the other marine vehicle hull and guide the flow of water around the underwater vehicle hull to pin the underwater vehicle against the other marine vehicle hull;

wherein said body panels include a bow panel and side panels, said bow panel being extendible forwardly from said underwater vehicle hull and said side panels being extendible from opposite sides of said underwater vehicle hull.

2. The underwater vehicle in accordance with claim 1 wherein said maneuvering planes include stern planes.

3. The underwater vehicle in accordance with claim 2 wherein said maneuvering planes further include bow planes.

4. An underwater vehicle having facility for maintaining station on an other marine vehicle hull, the underwater vehicle comprising:

a self-propelled underwater vehicle hull configured movement underwater;

maneuvering planes mounted on said underwater vehicle hull;

arms pivotally mounted on said underwater vehicle hull such that in a nonextended condition said arms are disposed within an outboard surface of said underwater vehicle hull, said arms being extendible from said underwater vehicle hull, said arm when extended being capable of engaging the other marine vehicle hull to generally conform to an outside configuration of the other marine vehicle hull; and attachment devices fixed to said arms to engage the other marine vehicle hull and hold said underwater vehicle onto the other marine vehicle hull;

wherein each of said arms comprises a series of linkages fixed pivotally to each other end-to-end; and wherein said underwater vehicle hull is provided with annular recesses therein and each of said arms is adapted to be disposed in one of said recesses in the non-extended condition.

5. The underwater vehicle in accordance with claim 4 wherein said maneuvering planes include stern planes.

6. The underwater vehicle in accordance with claim 5 wherein said maneuvering planes further include bow planes.

7. The underwater vehicle in accordance with claim 4 wherein said body panels include a bow panel extendible forwardly from said underwater vehicle hull.

8. The underwater vehicle in accordance with claim 7 wherein said body panels include side panels extendible from opposite sides of said underwater vehicle hull.

9. The underwater vehicle in accordance with claim 4 wherein said attachment devices comprise spikes.

10. The underwater vehicle in accordance with claim 4 wherein said arms comprise at least one set of arms, each set of arms comprising two arms extendible oppositely to each other to engage the other marine vehicle hull on opposite sides of the underwater vehicle.

11. An underwater vehicle having facility for maintaining station on an other marine vehicle hull, the underwater vehicle comprising:

a self-propelled underwater vehicle hull configured for movement underwater;

maneuvering planes mounted on said underwater vehicle hull;

arms pivotally mounted on said underwater vehicle hull such that in a nonextended condition said arms are disposed within an outboard surface of said underwater vehicle hull, said arms being extendible from said underwater vehicle hull, said arm when extended being capable of engaging the other marine vehicle hull to generally conform to an outside configuration of the other marine vehicle hull wherein each of said arms comprises a series of linkages fixed pivotally to each other end-to-end; and attachment devices fixed to said arms to engage the other marine vehicle hull and hold said underwater vehicle onto the other marine vehicle hull;

wherein said attachment devices comprise magnets.

12. The underwater vehicle in accordance with claim 11 wherein said magnets comprise electromagnets.

* * * * *